US009035185B2

(12) United States Patent
Bodziony et al.

(10) Patent No.: US 9,035,185 B2
(45) Date of Patent: May 19, 2015

(54) TOP-DRIVE POWER CABLE

(71) Applicant: Draka Holding N.V., Amsterdam (NL)

(72) Inventors: Matthew Bodziony, Berkley, MA (US); Walter Constantine, Warwick, RI (US); Damian Billeaudeau, Spring, TX (US); Almir Fonseca Menezes, Spring, TX (US)

(73) Assignee: Draka Holding N.V., Amsterdam (NL)

( * ) Notice: Subject to any disclaimer, the term of this patent is extended or adjusted under 35 U.S.C. 154(b) by 147 days.

(21) Appl. No.: 13/667,031

(22) Filed: Nov. 2, 2012

(65) Prior Publication Data

US 2013/0062093 A1 Mar. 14, 2013

Related U.S. Application Data

(63) Continuation-in-part of application No. PCT/US2011/034925, filed on May 3, 2011.

(60) Provisional application No. 61/330,723, filed on May 3, 2010.

(51) Int. Cl.

| | |
|---|---|
| ***H01B 7/18*** | (2006.01) |
| *H01B 7/04* | (2006.01) |
| *H01B 7/17* | (2006.01) |
| *H01B 7/282* | (2006.01) |
| *H01B 9/02* | (2006.01) |

(52) U.S. Cl.
CPC ..... *H01B 7/046* (2013.01); *H01B 7/183* (2013.01)

(58) Field of Classification Search
CPC ..... H01B 7/28; H01B 7/1865; H01B 7/17; H01B 7/0266; H01B 7/0225; H01B 7/0208; H01B 7/02; H01B 7/0009; H01B 1/02; H02G 9/00; D02G 3/047
See application file for complete search history.

(56) References Cited

U.S. PATENT DOCUMENTS

| | | | | |
|---|---|---|---|---|
| 4,317,000 | A | 2/1982 | Ferer | |
| 4,360,704 | A * | 11/1982 | Madry | 174/36 |
| 4,384,595 | A * | 5/1983 | Washkewicz et al. | 138/127 |
| 4,452,279 | A * | 6/1984 | Atwell | 138/126 |
| 4,663,954 | A | 5/1987 | Ziemek et al. | |

(Continued)

FOREIGN PATENT DOCUMENTS

| | | | | |
|---|---|---|---|---|
| CN | 201345234 | Y | 11/2009 | |
| CN | 201374209 | * | 12/2009 | H01B 7/04 |

(Continued)

OTHER PUBLICATIONS

Rosa et al. ("Highly Flexible Halogen Free and Flame Retardant Thermoplastic Cable Compounds Modified with EVM Polymers" presented at the International Wire & Cable Symposium (IWCS), Inc. : Proceedings of the 57th IWCS.*

(Continued)

*Primary Examiner* — Timothy Thompson
*Assistant Examiner* — Michael F McAllister
(74) *Attorney, Agent, or Firm* — Additon, Higgins & Pendleton, P.A.

(57) ABSTRACT

The invention relates to a cable suitable for supplying power to a drilling rig's top-drive assembly. In a typical embodiment, the power cable includes (i) a plurality of high-conductivity conductors, (ii) an electromagnetic shield, (iii) two protective sheaths, and (iv) a reinforcing layer of braided aramid fibers between the protective sheaths.

19 Claims, 2 Drawing Sheets

(56) References Cited

U.S. PATENT DOCUMENTS

| | | | | | |
|---|---|---|---|---|---|
| 4,675,475 | A | * | 6/1987 | Bortner et al. | 174/113 R |
| 4,749,823 | A | | 6/1988 | Ziemek et al. | |
| 4,898,212 | A | * | 2/1990 | Searfoss et al. | 138/130 |
| 5,023,405 | A | | 6/1991 | Kwast | |
| 5,119,457 | A | | 6/1992 | Callahan | |
| 5,172,765 | A | | 12/1992 | Sas-Jaworsky et al. | |
| 5,188,872 | A | * | 2/1993 | Quigley | 428/36.2 |
| 5,300,733 | A | * | 4/1994 | Uematsu | 174/106 SC |
| 5,414,211 | A | * | 5/1995 | Chan | 174/36 |
| 5,435,351 | A | | 7/1995 | Head | |
| 5,504,274 | A | * | 4/1996 | McCabe et al. | 174/36 |
| 5,526,846 | A | | 6/1996 | Maloberti | |
| 5,750,930 | A | * | 5/1998 | Buck et al. | 174/102 R |
| 5,828,003 | A | | 10/1998 | Thomeer et al. | |
| 6,246,006 | B1 | * | 6/2001 | Hardin et al. | 174/106 R |
| 6,424,768 | B1 | | 7/2002 | Booth et al. | |
| 6,566,604 | B2 | | 5/2003 | Booth et al. | |
| 7,157,645 | B2 | * | 1/2007 | Huffman | 174/120 R |
| 7,231,969 | B2 | | 6/2007 | Folk et al. | |
| 8,113,273 | B2 | * | 2/2012 | Manke et al. | 166/66.4 |
| 8,143,526 | B2 | * | 3/2012 | Hsu | 174/254 |
| 8,487,186 | B2 | | 7/2013 | Walid | |
| 2001/0025664 | A1 | * | 10/2001 | Quigley et al. | 138/125 |
| 2004/0055780 | A1 | | 3/2004 | Hakkarainen et al. | |
| 2009/0242708 | A1 | | 10/2009 | Schiefelbein, Jr. | |
| 2013/0062093 | A1 | | 3/2013 | Bodziony et al. | |

FOREIGN PATENT DOCUMENTS

| | | | | | |
|---|---|---|---|---|---|
| CN | 201374209 | Y | | 12/2009 | |
| DE | 3540684 | A1 | | 5/1987 | |
| EP | 1065674 | A2 | | 1/2001 | |
| EP | 1094194 | A2 | | 4/2001 | |
| GB | 2312794 | A | * | 11/1997 | H02G 3/04 |
| WO | 99/45548 | A1 | | 9/1999 | |
| WO | 01/78086 | A1 | | 10/2001 | |
| WO | 2004/008465 | A1 | | 1/2004 | |
| WO | 2009/087696 | A1 | | 7/2009 | |
| WO | 2011/140034 | A2 | | 10/2011 | |

OTHER PUBLICATIONS

Phillystran® Strength Members ( STRAND) Technical Bulletin 111-2/06 obtaind from Phillystran.*

International Search Report and Written Opinion in counterpart International Application No. PCT/US2011/034925 dated Jan. 24, 2012, pp. 1-15.

International Preliminary Report on Patentability in counterpart International Application No. PCT/US2011/034925 dated Nov. 6, 2012, pp. 1-9.

Amercable Inc., "Top Drive Service Loops," downloaded from http://www.amercablesystems.com/doc/Service.pdf on Mar. 24, 2014, pp. 1-8.

Amercable Inc., "Precision Engineered Cable Assemblies," downloaded from http://www.amercablesystems.com/doc/Assemblies.pdf on Mar. 24, 2014, pp. 1-8.

European Office Action in counterpart European Application No. 11720250.7 dated Mar. 10, 2015, pp. 1-7 [All other references previously cited].

* cited by examiner

TOP-DRIVE POWER CABLE

CROSS-REFERENCE TO PRIORITY APPLICATIONS

This application is a continuation-in-part of International Patent Application No. PCT/US2011/034925 for a Top-Drive Power Cable, filed May 3, 2011, (and published Nov. 10, 2011, as International Publication No. WO 2011/140034 A2), which itself claims the benefit of U.S. Patent Application No. 61/330,723 for a Top-Drive Power Cable (filed May 3, 2010). Each of the foregoing patent applications and patent application publication is hereby incorporated by reference in its entirety.

FIELD OF THE INVENTION

The present invention relates to an improved top-drive cable, which is particularly useful in petroleum-drilling deployments.

BACKGROUND

The top-drive assembly in land-based and offshore drilling rigs provides the rotational force needed to drill a borehole. Typically, several cables supply power to the motors within the top-drive assembly.

In conventional designs, these power cables are positioned within large-diameter rubber hoses with each power cable typically being secured to a rubber hose with a flexible epoxy. Each rubber hose may be clamped to a steel cable, which provides support to the power cables. The rubber hoses protect the power cables from harsh conditions experienced during drilling operations. Indeed, rubber hoses are used to protect the power cables, because conventional cable jackets do not provide sufficient mechanical protection.

The rubber hoses (and the power cables) typically are suspended from a position about midway on the drilling rig in a service loop. The service loop provides cable slack, thereby allowing the top-drive assembly to vertically reciprocate (i.e., move up and down the drilling rig).

Because each power cable in conventional designs is secured within a rubber hose (e.g., with an epoxy) that vertically reciprocates corresponding with the movement of the top-drive assembly, it is important for the power cable to be designed for continuous flexing operations. A cable having insufficient flexibility (e.g., not designed for continuous flexing) may suffer from undesirable fatigue and eventually break.

Furthermore, problems may arise if each power cable is not centered within its rubber hose in the service loop. A power cable that is not centered will have a different loop radius than the rubber hose. Whenever the power cable bends during operation (e.g., caused by the vertical reciprocation of the top-drive assembly), stresses occur in the power cable. Thus, if a power cable is not centered within the rubber hose, it will experience non-uniform stress, which can lead to the premature failure of the cable.

Another problem of conventional designs is that the power cable may become twisted because of the continuous reciprocation of the top-drive assembly.

The conductors within the power cable can also cause undesirable twisting. In addition to the hose, conductors within the power cable partially support the weight of the power cable. These elements, however, elongate at different rates, causing the conductors to become the primary support mechanism of the power cable. This, in turn, can lead to the power cable becoming twisted. Power cables employing a single conductor are particularly susceptible to such twisting. This twisting causes additional stresses in the power cable and eventually premature failure.

Accordingly, a need exists for an improved top-drive power cable that (i) resists cable rotation and (ii) does not need to be positioned within a rubber hose.

SUMMARY

Accordingly, in one aspect, the present invention embraces a top-drive power cable having one or more insulated high-conductivity conductors. Electromagnetic shielding typically encloses the high-conductivity conductors. A first polymeric sheath and a second polymeric sheath surround the electromagnetic shielding. A reinforcing layer of braided aramid fibers is positioned between the first and second polymeric sheaths. Typically, the reinforcing layer has a breaking strength of at least about 10,000 lbf (pound-force) (e.g., about 15,000 lbf or more).

In another aspect, the present invention embraces a method of supplying power to a top-drive assembly on a drilling rig. In particular, a top-drive power cable connects the top-drive assembly to a power source.

The foregoing illustrative summary, as well as other exemplary objectives and/or advantages of the invention, and the manner in which the same are accomplished, are further explained within the following detailed description and its accompanying drawings.

DETAILED DESCRIPTION

Figure 1:
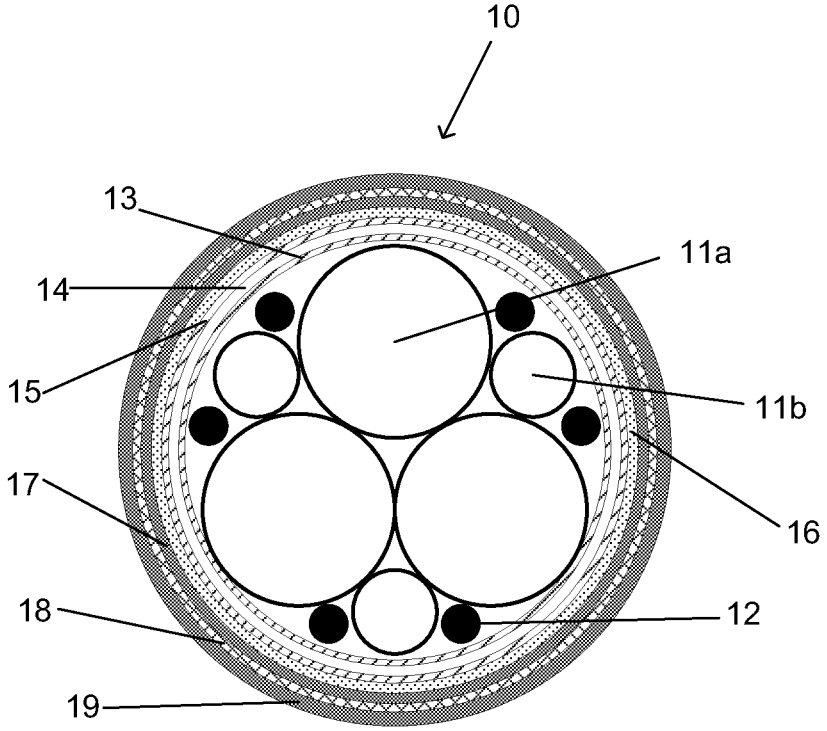
FIG. 1 schematically depicts a cross-sectional view of a top-drive power cable in accordance with one embodiment of the present invention.

In one aspect, the present invention embraces an improved top-drive power cable. In this regard, FIG. 1 depicts an exemplary top-drive power cable 10 in accordance with the present invention.

The power cable 10 includes one or more high-conductivity conductors 11. In one embodiment, the power cable 10 may include high-conductivity conductors 11 of different sizes. The larger diameter conductors 11*a* may be used as power conductors and the smaller diameter conductors 11*b* may be used as grounding conductors. For example, the larger diameter conductors 11*a* may be about 650 kcmil in size (i.e., having a cross-sectional area of about 650,000 circular mils), thus having a diameter of about 20.5 millimeters. The smaller diameters conductors 11*b* may be 2/0 AWG (American Wire Gauge) in size (i.e., having a cross-sectional area of 133,000 circular mils), thus having a diameter of about 9.3 millimeters. Typically, the high-conductivity conductors 11 are copper, although other high-conductivity metals (e.g., aluminum, silver, or gold) or metal alloys may be employed as an alternative to copper.

The foregoing notwithstanding, those of ordinary skill in the art will appreciate that the size of the high-conductivity conductors will depend upon the desired current-carrying capacity of the power cable 10. Indeed, because the current-carrying capacity of the power cable 10 depends upon the cross-sectional area of the high-conductivity conductors, greater current-carrying capacity requirements typically require larger diameter high-conductivity conductors.

Each conductor 11*a* and 11*b* may be individually insulated. For example, each conductor may be insulated with a chemically cross-linked polyolefin (e.g., having a thickness of between about one millimeter and three millimeters). Alternatively, and by way of example, the conductors may be insulated with silicone, a thermoset polymer, cross-linked polyethylene, halogen-free ethylene propylene rubber, and/or a low smoke, halogen-free cross-linked polyolefin.

The power cable 10 may include electromagnetic shielding. As depicted in FIG. 1 and by way of example, a layer of metal/polymeric tape 13 (e.g., aluminum/polyester tape) may surround the high-conductivity conductors 11. Typically, the metal/polymeric tape has two sublayers: (i) a polymeric layer (e.g., a polyester layer) and (ii) a metallic layer (e.g., a layer of aluminum or other highly conductive metal). In one embodiment, a braided shield layer 14 may be positioned between a first layer of an aluminum/polyester tape 13 and a second layer of an aluminum/polyester tape 15, thereby forming electromagnetic shielding. Typically, the metallic sublayer of each tape is positioned adjacent to, and more typically in contact with, the braided shield layer 14. Typically, the braided shield layer 14 is formed from a braid of tinned copper. Alternatively, the shield layer 14 is not braided but may be formed from a serving of tinned copper (e.g., a plurality of tinned copper wires helically wrapped around the cable). That said, other materials such as copper, aluminum, or bronze may be used to form the shield layer 14. For example, in an alternative embodiment the electromagnetic shielding may include a braided copper shield layer positioned between two layers of copper/polyester tape.

In a particular embodiment, the wires used to form the braided shield layer 14 may be 30 AWG in size (e.g., having a diameter of about 0.26 millimeter). That said, other sized wires are within the scope of the present invention. The braided shielding layer 14 typically provides coverage (i.e., the extent to which the underlying material is concealed) of between about 60 percent and 95 percent and, in combination with the tape layers 13 and 15, provides effective electromagnetic shielding.

A layer of rubber/fabric tape 16 may surround the electromagnetic shielding (e.g., surrounding the second layer of aluminum/polyester tape 15). Alternatively, an armor layer (e.g., formed from braided bronze) may surround the electromagnetic shielding.

The power cable 10 includes one or more polymeric sheaths enclosing the high-conductivity conductors. In one embodiment and as depicted in FIG. 1, the power cable 10 includes a first polymeric sheath 17 and a second polymeric sheath 19, typically enclosing a reinforcing layer 18. Each polymeric sheath may have a thickness of between about three millimeters and four millimeters. The polymeric sheaths 17 and 19 are typically formed of material that is resistant to drilling fluids, such as the "mud" used in drilling operations. Typically, the polymeric sheaths 17 and 19 are formed from a low-smoke, zero-halogen (LSZH), ester-based polymeric material. By way of example, the polymeric sheaths 17 and 19 may be formed from a cross-linked polyolefin or from nitrile rubber.

As noted, a reinforcing layer 18, typically formed of braided aramid fibers, may be positioned between the first polymeric sheath 17 and the second polymeric sheath 19. The reinforcing layer 18 supports (e.g., provides mechanical strength to) the power cable 10 when it is installed (e.g., suspended in a drilling rig). In this regard, the reinforcing layer 18 typically has a breaking strength of at least about 10,000 lbf (pound-force) (e.g., about 20,000 lbf or more). The power cable may be attached to a drilling rig by applying a grip (e.g., a basket-weave grip) over the second polymeric sheath 19.

Typically, the braided aramid fibers provide open coverage (e.g., coverage of between about 25 percent and 75 percent, more typically between about 40 percent and 60 percent, such as about 50 percent). The second polymeric sheath 19 is typically extruded over the aramid braid so that a portion of the second polymeric sheath 19 fills the gaps in the aramid braid, thereby integrating the second polymeric sheath 19 and the reinforcing layer 18. Extruding the second polymeric sheath 19 over the aramid braid so that a portion of the second polymeric sheath 19 not only fills the gaps in the aramid braid but also helps to facilitate coupling between the second polymeric sheath 19 and the first polymeric sheath 17 (e.g., to prevent the second polymeric sheath 19 and the first polymeric sheath 17 from sliding relative to one another).

The aramid braid typically is formed from a plurality of flat aramid strands. For example, the aramid braid may include 48, 36, 32, or 24 flat aramid strands. By way of example, each flat aramid strand may have a thickness of about 0.04 inch (i.e., about one millimeter) and a width of about 0.135 inch (i.e., about 3.4 millimeters). Depending upon the size of the power cable 10 and its desired strength, aramid strands of other sizes may be employed. To facilitate the formation of a flat strand, aramid fibers may be impregnated with a resin. The resin reduces the friction between the aramid strands and helps to ensure that the aramid strands are uniform in size and shape. Exemplary flat aramid strands (e.g., PHILLYSTRAN™ 49) are available from Phillystran, Inc. (Montgomeryville, Pa.).

Typically, the aramid braid employs a braid angle (i.e., the acute angle measured from the axis of the braid to a braiding strand) of between about 15 degrees and 45 degrees. More typically, the braid angle is between about 20 degrees and 30 degrees, such as between about 24 degrees and 27 degrees.

The design of the reinforcing layer 18 ensures that it provides sufficient strength to the power cable 10 and helps to prevent the rotation or twisting of the power cable 10 during use. In other words, the reinforcing layer 18 provides torque compensation to the power cable 10.

The power cable 10 may contain fire-resistant and non-hygroscopic fillers 12. Exemplary materials that can be used as fillers include glass fibers and/or polypropylene.

The power cable 10 typically has a weight of about 12.4 lbs/ft (pounds per foot). Moreover, in typical embodiments the power cable 10 has a voltage rating of at least about 2,000 volts, a minimum bending diameter of about six feet, a breaking strength of at least about 20,000 lbf, and a maximum working load of at least about 3,000 lbs.

The power cable 10 is expected to comply with the IEEE 1580 standard, the UL 1309 standard, and the IEC 60092-350 standard, each of which is hereby incorporated by reference in its entirety. Moreover, the power cable 10 is expected to be DNV and ABS Type Approved and ETL listed as a marine shipboard cable in accordance with the foregoing standards.

In another aspect, the present invention embraces a connected pair of top-drive power cables. Although the ensuing description relates to a connected pair of power cables, it is within the scope of the present invention to have more than two power cables connected together (e.g., three or more connected power cables).

Figure 2:
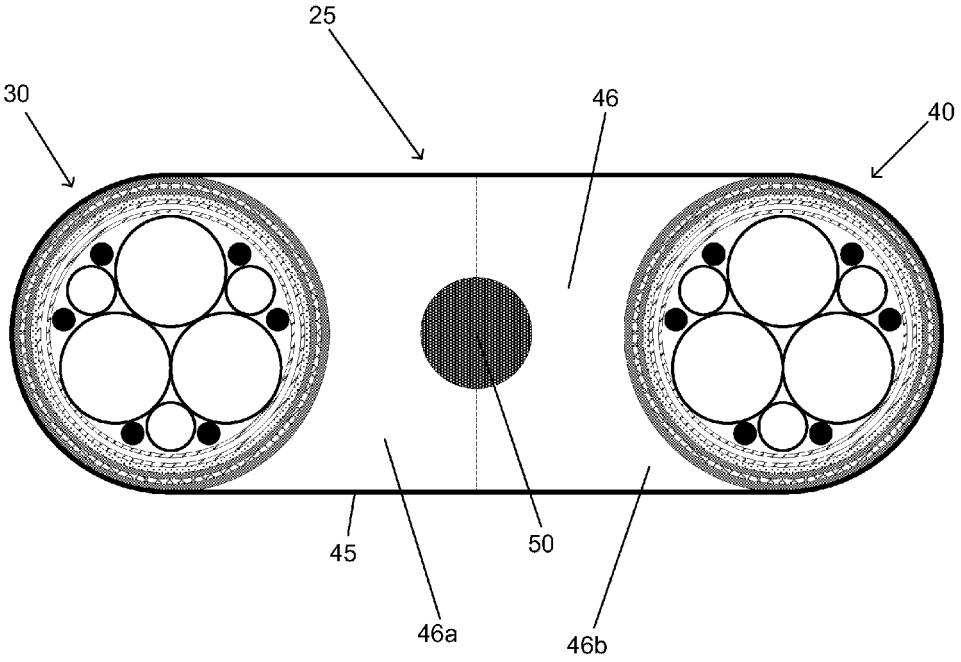
FIG. 2 schematically depicts a cross-sectional view of a connected pair of top-drive power cables in accordance with another embodiment of the present invention.

FIG. 2 depicts a connected pair 25 of two top-drive power cables 30 and 40. Typically, the power cables 30 and 40 are substantially identical. That said, it is within the scope of the present invention for the power cables 30 and 40 to have different designs and/or sizes.

The power cables 30 and 40 may be connected with a plurality of bandings 45 along the length of the power cables 30 and 40. For example, a banding 45 may be positioned approximately every 1.5 meters along the length of the power cables 30 and 40. Exemplary bandings 45 may have a width of between about 10 and 15 millimeters. Typically, the bandings are constructed from stainless steel, although other materials are within the scope of the present invention.

The connected pair 25 may include a core cable 50 (e.g., an independent wire rope core (IWRC)) running parallel to and positioned between the power cables 30 and 40. Typically, the core cable 50 is stainless steel and has a breaking strength of at least about 85,000 lbf. Alternatively, the core cable 50 may be formed from galvanized steel, aramid fibers, nylon, rayon, polyester (e.g., Dacron® polyethylene terephthalate), and/or other synthetic materials. The core cable 50 may be attached to the connected pair 25 using a plurality of saddles 46 positioned along the length of the core cable 50. Typically, each saddle 46 includes two halves 46*a* and 46*b* that are placed around the core cable 50. Each saddle may have a length of between about 50 millimeters and 200 millimeters. Typically, adjacent saddles are separated by a space of between about one meter and three meters. In an alternative embodiment, a saddle extending along a substantial length of the core cable 50 may be employed.

The saddles 46 are attached to the connected pair 25 with the bandings 45. Moreover, the core cable 50 is mechanically coupled (e.g., potted) to each end of connected pair 25. Accordingly, the core cable 50 provides additional mechanical support and torque resistance to the connected pair 25.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A power cable for use on a drilling rig, comprising:
one or more insulated high-conductivity conductors;
electromagnetic shielding enclosing said high-conductivity conductors;
a first polymeric sheath surrounding said electromagnetic shielding;
a reinforcing layer of braided aramid fibers circumferentially surrounding said first polymeric sheath, said reinforcing layer (i) defining a reinforcing-layer aramid braid having gaps, (ii) providing coverage of between about 40 percent and 60 percent and (iii) having a breaking strength of at least about 10,000 lbf; and
an extruded, second polymeric sheath surrounding said reinforcing layer, said second polymeric sheath filling the gaps in said reinforcing-layer aramid braid to thereby integrate said second polymeric sheath and said reinforcing layer.

2. The power cable according to claim 1, comprising an armor layer positioned between said electromagnetic shielding and said first polymeric sheath.

3. The power cable according to claim 1, comprising a layer of rubber/fabric tape positioned between said electromagnetic shielding and said first polymeric sheath.

4. The power cable according to claim 1, wherein said high-conductivity conductors comprise copper, gold, silver, and/or aluminum.

5. The power cable according to claim 1, wherein said electromagnetic shielding comprises:
a first tape layer;
a second tape layer; and
a braided shield layer positioned between said first and second tape layers.

6. The power cable according to claim 5, wherein:
said first and second tape layers comprise aluminum/polyester tape; and
said braided shield layer comprises tinned copper.

7. The power cable according to claim 5, wherein:
said first and second tape layers comprise copper/polyester tape; and
said braided shield layer comprises copper.

8. The power cable according to claim 1, wherein each of said first and second polymeric sheaths comprises a low-smoke, zero-halogen (LSZH) polymeric material.

9. The power cable according to claim 1, wherein each of said first and second polymeric sheaths comprises a cross-linked polyolefin and/or nitrile rubber.

10. The power cable according to claim 1, wherein said reinforcing layer comprises a plurality of flat aramid strands.

11. The power cable according to claim 1, wherein said reinforcing layer comprises flat, resin-impregnated aramid strands.

12. The power cable according to claim 1, wherein said reinforcing layer employs a braid angle of between about 15 degrees and 45 degrees.

13. The power cable according to claim 1, wherein said reinforcing layer employs a braid angle of between about 20 degrees and 30 degrees.

14. The power cable according to claim 1, wherein said reinforcing layer employs a braid angle of between about 24 degrees and 27 degrees.

15. The power cable according to claim 1, wherein said reinforcing layer provides coverage of about 50 percent.

16. The power cable according to claim 1, wherein said reinforcing layer has a breaking strength of at least about 20,000 lbf.

17. A connected pair of power cables, comprising;
two power cables, each according to claim 1, said cables being positioned substantially parallel to one another;
a core cable positioned between and substantially parallel to said power cables; and
a plurality of banding connecting said power cables and said core cable.

18. A power cable for use on a drilling rig, comprising:
one or more insulated high-conductivity conductors;
electromagnetic shielding enclosing said high-conductivity conductors;
a first polymeric sheath surrounding said electromagnetic shielding;
a reinforcing layer of braided aramid fibers circumferentially surrounding said first polymeric sheath, said reinforcing layer (i) defining a reinforcing-layer aramid braid having gaps, (ii) employing a braid angle of between about 15 degrees and 45 degrees and (iii) having a breaking strength of at least about 10,000 lbf; and
an extruded, second polymeric sheath surrounding said reinforcing layer, said second polymeric sheath filling the gaps in said reinforcing-layer aramid braid to integrate said second polymeric sheath and said reinforcing layer and to facilitate coupling between said first and second polymeric sheaths.

19. The power cable according to claim 18, wherein said reinforcing layer employs a braid angle of between about 24 degrees and 45 degrees.

* * * * *